United States Patent [19]

Hruby, Jr.

[11] 4,204,631

[45] May 27, 1980

[54] NOZZLE FOR CANOPY-STYLE WATER FOUNTAINS

[75] Inventor: John O. Hruby, Jr., Burbank, Calif.

[73] Assignee: Rain Jet Corporation, Burbank, Calif.

[21] Appl. No.: 28,220

[22] Filed: Apr. 9, 1979

[51] Int. Cl.[2] ..... B05B 17/08

[52] U.S. Cl. ..... 239/17; 239/552; 239/DIG. 16

[58] Field of Search ..... 239/17-23, 239/552, 553, 553.5, DIG. 16

[56] References Cited

U.S. PATENT DOCUMENTS

| | | | |
|---|---|---|---|
| 3,690,554 | 9/1973 | Hruby, Jr. | 239/17 |
| 3,773,257 | 11/1972 | Hruby, Jr. | 239/17 |
| 3,784,101 | 1/1974 | Frempter | 239/17 |

*Primary Examiner*—Johnny D. Cherry
*Assistant Examiner*—Michael J. Forman
*Attorney, Agent, or Firm*—Christie, Parker & Hale

[57] ABSTRACT

An ornamental fountain nozzle for generating a plurality of nonaerated water streams includes a body defining a chamber therein. A plug is disposed across an upper water outlet opening of the body and has a portion of its length outside the body. A plurality of grooves are formed at intervals in the circumference of the plug and have their lengths substantially aligned with the length of the plug. The grooves have a substantial portion of their length disposed within the body. The grooves have lower ends which communicate with the chamber and upper ends which communicate with the exterior of the nozzle only through the peripheral walls of the plug above the upper end of the body. Each groove has a base element therealong located farthest inwardly of the groove from the plug peripheral walls. The base element of each groove is sloped outwardly relative to the length of the body proceeding upwardly along the groove. The grooves also have side wall surfaces between the groove base element and the adjacent peripheral walls of the plug, and these side walls converge toward each other proceeding upwardly along the length of the groove. Between the grooves, the plug peripheral walls are engaged in surface-to-surface contact with the interior of the body adjacent the top of the body so that the only outlet of water from the chamber between the plug and the body is via the grooves.

4 Claims, 2 Drawing Figures

NOZZLE FOR CANOPY-STYLE WATER FOUNTAINS

FIELD OF THE INVENTION

This invention pertains to liquid handling and, more particularly, to ornamental fountain nozzles arranged to discharge a plurality of separate unaerated water streams.

REVIEW OF THE PRIOR ART

My prior U.S. Pat. Nos. 3,690,554 and 3,773,257 describe nozzles of the general type to which this invention pertains. In nozzles of this type, the objective is to discharge a plurality of water streams which are as unaerated as possible so that each stream appears adjacent the nozzle as a rod of crystal. Remote from the nozzle, each stream breaks up into crystalline droplets which fall back into a pool into which the nozzle is located with its upper end above the water surface. The more unaerated the stream of water discharged from the nozzle, the more crystalline and refractive are the water streams and droplets, and the greater the ornamental effect of the fountain, particularly when the fountain is artificially illuminated.

As described in my prior patents, nozzles of the type to which this invention pertains are structurally simple. They comprise, basically, a tubular body having a lower water inlet end and an upper water outlet end, and a plug fixedly disposed in the body at its water outlet end. A plurality of water discharge grooves are formed in the peripheral walls of the plug. The grooves have their lower ends communicating with a water chamber within the body below the plug, and have their upper ends communicating with the exterior of the nozzle above the upper end of the body. The grooves have base elements which extend along their length closest to the center of the plug, which base elements slope upwardly and outwardly relative to the length of the plug.

Nozzles of the general type described in my prior patents produce attractive and appealing fountain discharge patterns in use. It has been found, however, that the water streams which are discharged from the prior nozzles have some slight degree of aeration, and also tend to produce a fine spray or fuzz immediately adjacent the outlet openings of the grooves. The presence of the fuzz in the discharge pattern detracts from the aesthetic properties of the pattern, especially when the pattern is artificially illuminated. A need exists for fountains of the general type described above which provide substantially reduced fuzz at the nozzle itself, and which produce discharge water streams having reduced aeration.

SUMMARY OF THE INVENTION

This invention is addressed to the need identified above. It provides an unaerating fountain nozzle characterized by substantial reduction of fuzz adjacent the locations at which individual water streams emanate from the nozzle structure, and in which the water streams are more crystalline than heretofore provided. With reference to the structures described in my prior patents, these objectives are obtained in nozzles of this invention by causing the grooves to be defined in such manner that the base elements of individual grooves slope upwardly and outwardly, as previously was the case, and by also causing the side walls of the grooves to converge toward each other proceeding upwardly along the grooves. The water discharge grooves in the nozzles described in my prior patents had side wall surfaces which were parallel to each other.

In general, therefore, the present invention provides an ornamental fountain nozzle which comprises an elongate body defining therein a chamber having a lower water inlet opening and an upper water outlet opening. A plug is fixedly disposed across the chamber at the body outlet opening with a portion of the length of the plug disposed within a portion of the chamber adjacent the water outlet. The plug has peripheral walls outside the body which define an extension of the adjacent portion of the chamber. A plurality of grooves are formed at intervals in the circumference of the plug. The grooves have a substantial portion of their length disposed within the body. The grooves have lower ends which communicate with the chamber within the body and upper ends which communicate with the exterior of the nozzle only through the plug peripheral walls above the body water outlet opening. Each groove has a base element along the portion of the groove which is most remote from the adjacent peripheral walls of the plug. Each groove base element is inclined outwardly from the length of the plug proceeding upwardly along the length of the groove. Each groove also has side wall surfaces between the groove base element and the adjacent plug peripheral walls. The groove side wall surfaces converge toward each other proceeding upwardly along the length of the grooves. Between the grooves, the plug is engaged in surface-to-surface contact with the chamber walls adjacent the body water outlet opening so that the only outlet of water through the chamber between the plug and the body is via the several grooves.

DESCRIPTION OF THE DRAWINGS

The above-mentioned and other features of this invention are more fully set forth in the following detailed description of the presently preferred embodiment of this invention, which description is presented with reference to the accompanying drawing, wherein.

DESCRIPTION OF THE ILLUSTRATED EMBODIMENT

Figure 1:
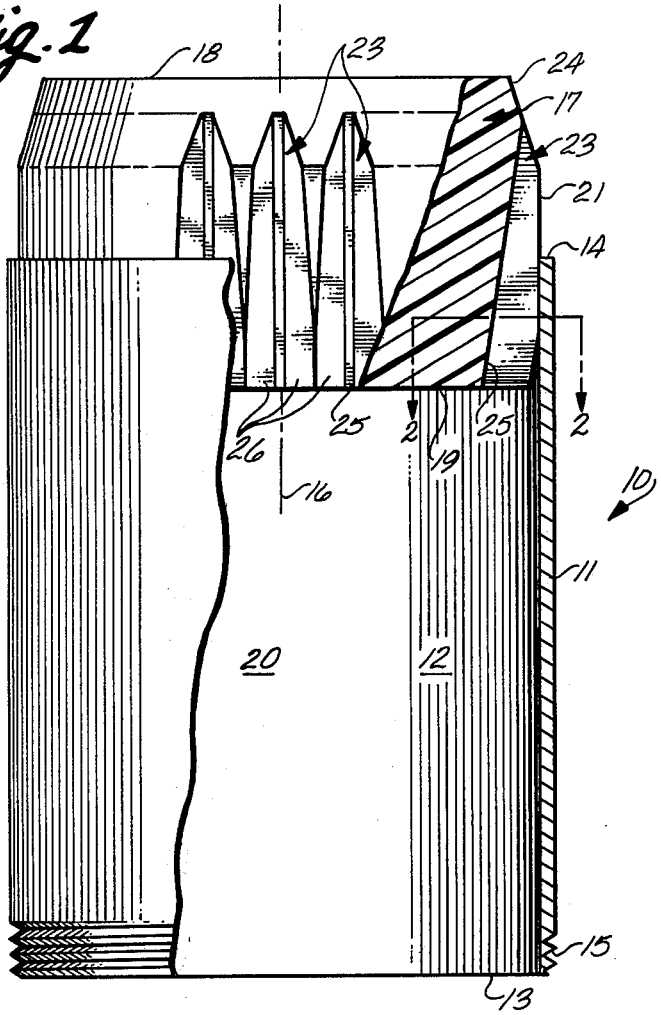
FIG. 1 is an elevation view, partially in cross-section, of a fountain nozzle according to this invention.

Ornamental fountain nozzle 10, shown in FIG. 1, includes an elongate, hollow, tubular body 11 which defines an elongate, straight, circularly cylindrical duct 12. The duct extends from a lower water inlet opening defined across a lower end 13 of the body to an upper water outlet defined across the upper end 14 of the body. Adjacent its lower end, the body is arranged, as by external threads 15, to be connected to a suitably sized, preferably vertically disposed water discharge pipe or nozzle support base through which water at suitable pressure is applied to the nozzle for discharge by the nozzle of a characteristic ornamental discharge pattern. The discharge pattern is composed of a plurality of discrete unaerated diverging water streams concentric about an axis 16 of the nozzle.

A plug 17, which has substantial length between its opposite ends 18 and 19 relative to the diameter of the duct 12, is disposed across the duct at the upper end of the body. The plug is so disposed in the body that a portion of the length of the plug is disposed above the upper end of the body. The location of the plug across the outlet end of the body produces a chamber 20 within the body below the plug and to which the body inlet opening communicates. Preferably the top 18 and bottom 19 plug surfaces are parallel to each other and are normal to the length of duct 12. The plug has a right circularly cylindrical peripheral surface 21 which is sufficiently close in diameter to the diameter of duct 12 that, when the plug is disposed in the duct as shown, its peripheral wall surfaces 22 are snugly and intimately engaged in contact with the duct walls around the entirety of the plug at least adjacent to the top of the body except where the plug is recessed to define a plurality of grooves 23. The upper rim of the plug, i.e., the intersection of the plug peripheral wall 22 with the plug top surface 18 is chamfered, i.e., relieved, to define a chamfer surface 24 which extends circumferentially of the plug. The chamfer angle of surface 24 relative to axis 16 is on the order of about 20°.

Preferably duct 12 is straight between its opposite ends through the body. In some instances, however, the duct may be other than straight between its opposite ends and in these instances it is preferred that the duct be straight for a substantial distance away from the plug toward the inlet end of the body, and that throughout this straight portion the duct be of constant cross-sectional area and configuration to assure that the water which approaches grooves 23 flows straight into the grooves and does not swirl or the like. The presence of swirl or other turbulence in the water entering grooves 23 tends to be manifested by aeration of or instability in the several water streams discharged from nozzle 10.

Grooves 23 are defined in the plug wall surfaces at intervals about the cylindrical extent of the peripheral surface. The grooves communicate with the chamber 20 through the plug bottom surface 19 and communicate at their upper ends to the exterior of the nozzle. The communication of the grooves to the exterior of the nozzle provides the only communication between the plug and the body for the passage of water from the interior of the nozzle to its exterior during use of the nozzle. Preferably, for the reasons set forth in U.S. Pat. No. 3,773,257, no portion of the outlet openings of any of grooves 23 lies within plug top surface 18. Instead, the grooves open to the exterior of the nozzle only through plug side wall 22 and through chamfer surface 24. Accordingly, the only way in which water can exit between the plug and the nozzle body is via grooves 23 because the plug peripheral surface 21 makes surface-to-surface contact with the inner walls of the body between the grooves adjacent the body outlet opening.

Figure 2:
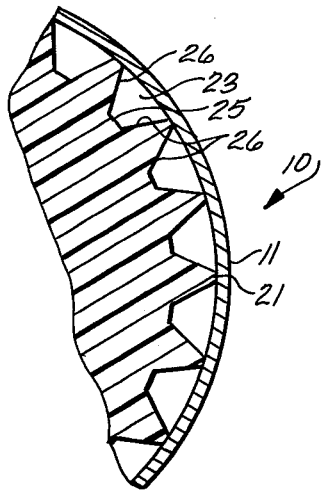
FIG. 2 is a plan view taken along line 2—2 in FIG. 1.

As shown in FIG. 1, grooves 23 are tapered in that each groove has a base element 25 which extends along the length of the groove and which is sloped upwardly and outwardly from the nozzle axis proceeding from the inlet to the outlet end of the groove. The nozzle base element is defined as that element or line of the groove which extends along the length of the groove and is closest to the nozzle axis at any point along the length of the groove. As shown in FIG. 2, grooves 23, which have the preferred configuration according to this invention, have flat base surfaces (which include the groove base elements) between groove side wall surfaces 26. The groove side wall surface face each other and extend between the corresponding groove base surface and the plug peripheral walls 21. It is within the scope of this invention, however, that the bottom or base of the grooves, i.e., the portions of the grooves closest to nozzle axis 16, may be of semi-circular configuration, in which case the groove base element would be that line along the semi-circular bottom or base of the groove which is closest to the nozzle axis at each increment of the length of the groove.

It is noted that in the nozzles described in the prior patents mentioned above, the grooves there disclosed have base elements which slope upwardly and outwardly relative to the nozzle axis. The principal difference between grooves 23 in nozzles according to this invention and the grooves encountered in the nozzles described in the prior patents is that the side walls of grooves 23 converge toward each other proceeding upwardly along each groove. In nozzles according to the prior patents, the groove side wall surfaces were parallel to each other along the length of the groove. Because groove side wall surfaces 26 converge in the manner shown best in FIG. 1, the change in area of the grooves, as a function of their length from their bottom or inlet ends, is greater in grooves 23 than in the grooves of the nozzles described in the prior patents. In effect, grooves 23 decrease in area because of (1) the outwardly sloping nature of base elements 25 and (2) the inwardly converging nature of groove side walls 26. The effect, therefore, is to cause water flowing through the grooves from chamber 20 to be squeezed both inwardly, by the groove side walls, and outwardly, by the groove base elements, to provide a finer focus of the water stream emanating from the open upper end of each groove. This finer focus results in reduced fuzz or droplet formation immediately adjacent the exterior of the nozzle as the individual water streams exit from grooves 23. Also, the water streams emanating from grooves 23 have lower residual aeration than is encountered in the water streams produced by nozzles of the type shown in the patents identified above. The result is that the water streams produced by nozzles according to this invention have a much greater crystalline appearance, and better refract and reflect light therefrom when they are naturally and artificially illuminated.

As the individual water streams pass from grooves 23 during operation of nozzle 10, the water streams break up into individual droplets which are remarkably free from aeration and which themselves act as water prisms to reflect and refract incident light. The overall aesthetic effect of the fountain pattern produced by nozzle 10 is discernibly alive and very appealing.

Preferably groove side wall surfaces 26 are flat. Because both the groove side wall surfaces converge smoothly toward each other, and because the groove base elements slope outwardly, the rate of change in the groove area along the length of each groove is nonlinear.

While it is preferred that groove side wall surfaces 26 be flat, it is within the scope of this invention that the side wall surfaces may be nonplanar so that they converge toward each other proceeding upwardly along the length of the groove, but that the rate of convergence be nonlinear. In any event, there should be no abrupt changes in area in the groove from point to point along its length; such abrupt changes result in the creation of turbulence in the water streams flowing through the grooves, which turbulence in turn produces aeration of the water stream.

It has been found that, if grooves 23 are defined in plug 17 by a machining process as opposed to the fabrication of plug 17 by a casting process, the grooves can be formed more uniformly in the surfaces of the plug than has heretofore been the case. Uniformity between the several grooves around the circumference of the plug results in a fountain nozzle which produces a more uniform and thereby a more aesthetic discharge pattern.

FIG. 2 shows the cross-sectional shape of grooves 23 at a selected location along their length. At other locations along the grooves, their cross-sectional configuration will be similar to that shown in FIG. 2; only the groove water flow area wil be different. Also, FIG. 2 shows that the included angle between each groove side wall surface 26 and the inner walls of body 11 is a substantial angle, albeit one less than 90°. Preferably the included angle of convergence between the side wall surfaces is in the range of from about 8° to about 60°; appreciably higher convergence angles result in the included angles between side wall surfaces and the body being sufficietly small to result in the generation of objectionable fuzz as the water streams exit from the grooves.

The angle of slope of grooves 23 outwardly relative to the nozzle axis preferably is in the range of from about 5° to about 20°.

Grooves 23 are disposed parallel to nozzle axis 16; i.e., they are not disposed skew or in a helical manner relative to the nozzle axis. It is within the scope of this invention, however, that the grooves can be given a skew or helical orientation in the exterior of the plug.

This invention also contemplates that additional water flow paths can be provided through the plug, as along the nozzle axis, to produce other aspects of a desired fountain pattern. However, the only water flow paths provided between the plug and the body are defined by the grooves formed in the periphery of the plug as described above.

It will be observed that nozzle 10 is structured to produce all of the benefits and advantages described in prior U.S. Pat. Nos. 3,690,554 and 3,784,101, but with the further advantages set forth above produced by the convergence of the groove side walls in combination with the outward slope of the groove base elements.

Workers skilled in the art to which this invention pertains will appreciate that the preceding description has involved an explanation of the structure of the embodiment of the invention which is presently preferred. Such workers will appreciate that this invention can be embodied in structures different from that described above and shown in the accompanying drawings. Accordingly, the preceding description has been set forth by way of example in compliance with the requirements of the applicable statutes and should not be considered as limiting the scope of this invention.

What is claimed is:

1. An ornamental fountain nozzle comprising an elongate body defining therein a chamber having a lower water inlet opening thereto and an upper water outlet opening therefrom, a plug fixedly disposed across the chamber at the outlet opening with a portion of the length of the plug disposed within a portion of the chamber adjacent the water outlet opening, the plug having peripheral walls outside the body defining an extension of said portion of the chamber, and a plurality of grooves formed at intervals in the circumference of the plug with a substantial portion of their length disposed within the body, the grooves having lower ends communicating with the chamber and upper ends communicating with the exterior of the nozzle only through said plug peripheral walls above the water outlet opening from the body, each groove having a base element therealong most remote from the adjacent peripheral walls of the plug, the base element being inclined outwardly from the length of the plug proceeding upwardly along the length of the groove, each groove having side wall surfaces between the groove base element and the adjacent plug peripheral walls which converge toward each other proceeding upwardly along the length of the groove, the plug between the grooves being engaged in surface-to-surface contact with the chamber walls adjacent the body water outlet opening so that the only outlet of water from the chamber between the plug and the body is via the grooves.

2. A nozzle according to claim 1 wherein the base element of each groove is defined by a flat surface which opens away from the plug.

3. A nozzle according to claim 1 wherein the angle of convergence of the groove side wall surfaces is in the range of from about 8° to about 60°.

4. A nozzle according to claim 1 wherein the side wall surfaces of each groove are cooperatively related so that the cross-sectional area of the groove decreases proceeding upwardly along the length of the groove irrespective of the outward inclination of the groove base element.

* * * * *